US007607859B2

(12) United States Patent
Shaw et al.

(10) Patent No.: US 7,607,859 B2
(45) Date of Patent: Oct. 27, 2009

(54) SURFACE SEEDED FINE AGGREGATE CONCRETE SIMULATING QUARRIED STONE

(75) Inventors: Ronald D. Shaw, Corona Del Mar, CA (US); Lee A. Shaw, Newport Beach, CA (US)

(73) Assignee: Lithocrete, Inc., Costa Mesa, CA (US)

( * ) Notice: Subject to any disclaimer, the term of this patent is extended or adjusted under 35 U.S.C. 154(b) by 259 days.

(21) Appl. No.: 11/515,684

(22) Filed: Sep. 5, 2006

(65) Prior Publication Data

US 2007/0071551 A1 Mar. 29, 2007

Related U.S. Application Data

(63) Continuation-in-part of application No. 11/236,973, filed on Sep. 28, 2005, now Pat. No. 7,322,772.

(51) Int. Cl.
*E01C 7/35* (2006.01)

(52) U.S. Cl. ..... 404/75; 404/72; 404/81

(58) Field of Classification Search ..... 404/75, 404/19, 20, 71, 72, 81; 52/315, 414, 612
See application file for complete search history.

(56) References Cited

U.S. PATENT DOCUMENTS 2,296,453 A * 9/1942 Saffert ..... 264/131
3,441,457 A * 4/1969 Regnaud ..... 156/71
4,748,788 A * 6/1988 Shaw et al. ..... 52/741.11
4,915,888 A * 4/1990 Sato ..... 264/71
5,395,673 A * 3/1995 Hunt ..... 428/148
5,794,401 A * 8/1998 Shaw et al. ..... 52/741.41
6,016,635 A * 1/2000 Shaw et al. ..... 52/741.41
6,033,146 A 3/2000 Shaw et al.
6,610,224 B2 * 8/2003 Sullivan ..... 264/34
6,780,369 B1 * 8/2004 Darrow et al. ..... 264/426
7,051,483 B2 * 5/2006 Bamford ..... 52/414
2003/0140594 A1 * 7/2003 Shaw et al. ..... 52/741.41
2004/0041295 A1 * 3/2004 Shaw et al. ..... 264/131

* cited by examiner

*Primary Examiner*—Raymond W Addie
(74) *Attorney, Agent, or Firm*—Stetina Brunda Garred & Brucker

(57) ABSTRACT

A method of surface seeded fine aggregate to produce simulated quarried stone. The method comprises preparing a subgrade, pouring a concrete mixture over the subgrate, and broadcasting one of fine sand and aggregate over 5% to 60% of an exposed surface of the concrete mixture. Alternatively, both the fine sand and the aggregate can be broadcast over 5% to 60% of the exposed surface of the concrete mixture to obtain a desired aesthetic effect as provided by the quarried stone.

22 Claims, 2 Drawing Sheets

SURFACE SEEDED FINE AGGREGATE CONCRETE SIMULATING QUARRIED STONE

CROSS-REFERENCE TO RELATED APPLICATIONS

This application is a continuation-in-part of U.S. patent application Ser. No. 11/236,973 entitled "Surface Seeded Fine Aggregate Concrete Simulating Quarried Stone" filed Sep. 28, 2005, now U.S. Pat. No. 7,322,772 which is incorporated by reference hereinwith.

STATEMENT RE: FEDERALLY SPONSORED RESEARCH/DEVELOPMENT

Not Applicable

BACKGROUND

The present invention relates in general to concrete products and method of producing the same, and more particularly, to a simulated quarried stone produced by surface seeded exposed aggregate concrete.

As is well known in the building and construction trade, concrete is extensively utilized as a building material for industrial, commercial and residential applications. Due to its durability, water resistance, and cost economy, concrete has gained wide spread use in flooring applications. With this wide spread use, the public is currently demanding variations in color, surface texture and overall appearance of concrete so that the concrete possesses improved aesthetics similar to more conventional and costly flooring surfaces such as marble, stone and granite.

In order to meet this demand, the concrete trade has developed various coloring and surface finishing techniques to enhance the aesthetics of concrete. Examples of such finishing techniques include salt finish, multiple broom finish, form press finish (e.g. stamped concrete), and exposed aggregate finish.

With particular to exposed aggregate finish, one of two different production methods or techniques is typically utilized to form the same. The first is the "integrally exposed aggregate method", which is the conventional of the two techniques. The integrally exposed aggregate method entails washing or removing surface cement and fines from the concrete while the concrete surface is still plastic, that is, prior to full curing, such that the aggregate (which is normally rock or gravel) is left exposed on the surface of the concrete. Due to the fact that the concrete aggregate is relatively large in size (that is, approximately one-half inch to one inch in mean diameter), as well as the fact that the washing process is not uniform in nature, the resultant concrete surface produced via the integrally exposed aggregate method is often extremely rough and jagged. This characteristic limits wide spread use of the integrally exposed aggregate method in flooring application. Further, the rough and jagged appearance also fails to create the aesthetic appearance of stone or marble that is desired.

The second method is the "surface seeded exposed method" which has recently been introduced into the trade. In this particular method, rock or gravel aggregate is scattered (that is, broadcasted or seeded) over the top surface of the concrete and subsequently troweled into the same subsequent to pouring the concrete. As the concrete cures, the aggregate becomes adhered to the top surface of the concrete and is thus exposed. Although various sizes of aggregate can be broadcast over the tope surface of the concrete by this method, the diameter of the aggregate is normally about three-eighths inch or greater; and sheared edges or jagged edges are often resulted. The size and shape of the aggregate allow it to be worked into the top surface of the concrete and adequately adhered thereto. However, although the resultant concrete surface produced by the surface seeded exposed aggregate method is flatter than the surface produced by the integrally exposed aggregate method, neither surface is free of irregularities; and both surfaces still possess extremely rough surface finish which limits their wide spread use in flooring applications. In particular, neither method produces a surface finish comparable to that of marble, stone, or granite.

In order to overcome the above-mentioned deficiencies of the prior art, methods have been developed to enhance the surface finish of concrete by reducing the size of the aggregate exposed on the surface of the concrete. However, as the aggregate decreases in size, other challenges develop due to the alkali-silica reaction (ASR). ASR is a chemical process through which alkalis from cement and silica from aggregate combine with each other to form a gel that expands in the presence of moisture and causes cracking in concrete and disrupts the adhesion of aggregate to the top surface of the concrete.

In response to the challenges that ASR presents, other methods have been developed to obtain sufficient surface flatness while substantially eliminating the effects of ASR. In particular, several of those methods are described in U.S. Pat. No. 4,748,788, U.S. Pat. No. 6,033,146 and U.S. Pat. No. 6,033,146, the contents of which are incorporated by reference hereinwith. The techniques as described in the above-mentioned patents issued to the Applicant overcame many of the deficiencies of the prior art and produced improved surface finishes on surface seeded exposed aggregate concrete. In particular, the concrete resultant from practice of the above-mentioned patents exhibits an extremely flat exposed aggregate surface suitable for extremely high traffic flooring applications. However, the above surface seeded exposed aggregate method requires both aggregate and fine sand to be broadcast over the 100% of the exposed surface of the concrete mixture. In addition, although the surface seeded exposed aggregate method has hitherto been refined to produce surfaces that assimilate more costly surfaces such as stone, marble, or granite, no process has been developed to model the fine, medium, and coarse grain textures of natural quarried stone.

Therefore, there is a need in the art for a surface seeded exposed aggregate method that produces surfaces which model the fine, medium and coarse grain textures of natural quarried stones. Further, there is a need in the art for a surface seeded exposed aggregate method that incorporates flecks, speckles and inclusion of natural quarried stone.

BRIEF SUMMARY

A method of surface seeded fine aggregate is provided to produce simulated quarried stone. The method comprises preparing a subgrade, pouring a concrete mixture over the subgrate, and broadcasting one of fine sand and aggregate over 5% to 60% of an exposed surface of the concrete mixture. Preferably, the subgrade is prepared by the steps of adding moist fill sand on a surface and positioning reinforcement members on the moist fill sand. In one embodiment, the moist fill sand is added with a thickness no less than 4 inches, and the concrete mixture is poured to a thickness between about 3½ inches and about 4 inches. The reinforcement members may include wire mesh or rebar. After the concrete mixture is poured and before the fine sand or the aggregate is applied, a step of bull float is preferably performed to level and finish the exposed surface of the concrete mixture. When the fine sand is selected and broadcast over the exposed surface of the concrete mixture, the aggregate may further be broadcast on the exposed surface of the concrete mixture. Again, the aggregate is preferably broadcast over only 5% to 60% of the exposed surface of the concrete mixture. The aggregate may include glass, mica or any other negative aggregate and mineral.

The method of surface seeded fine aggregate may further comprise a step of mixing the fine sand or aggregate into cement or fine paste at the exposed surface of the concrete mixture after the fine sand or the aggregate is broadcast. Thereby, the fine sand and/or the aggregate can be fully embedded into the cement/fine paste at the exposed surface of the concrete mixture and thoroughly adhered or bonded to the exposed surface of the concrete mixture. Preferably, a power trowel may be used to performing the step of mixing the fine sand or aggregate into the cement or fine paste at the exposed surface of the concrete mixture.

Subsequent to the mixing step, a step of massaging a surface retarder to the exposed surface of the concrete mixture, and a step of forming a vapor barrier on the exposed of the exposed surface of the concrete mixture are performed. The vapor barrier can be formed by applying a liquid chemical evaporation reducer to the exposed surface of the concrete mixture or by covering the exposed surface of the concrete mixture by a predetermined length of visquene. The vapor barrier is preferably maintained on the exposed surface of the concrete mixture for a predetermined period of time, such as two to twenty-four hours. Any surface films of the exposed surface of the concrete mixture are preferably removed after the vapor barrier is formed and maintained for the predetermined period of time followed by a step of water curing.

A simulated quarried stone fabricated by a method of surface seeded fine aggregate concrete is also provided. The method of surface seeded fine aggregate concrete includes the steps of preparing a subgrade, pouring a concrete mixture over the subgrate, and broadcasting one of fine sand and aggregate over 5% to 60% of an exposed surface of the concrete mixture. When the fine sand is selected and broadcast over 5% to 60% of the exposed surface of the concrete mixture, the aggregate may further be broadcast over the exposed surface. Similarly, the aggregate is preferably broadcast over only 5% to 60% of the exposed surface of the concrete mixture.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
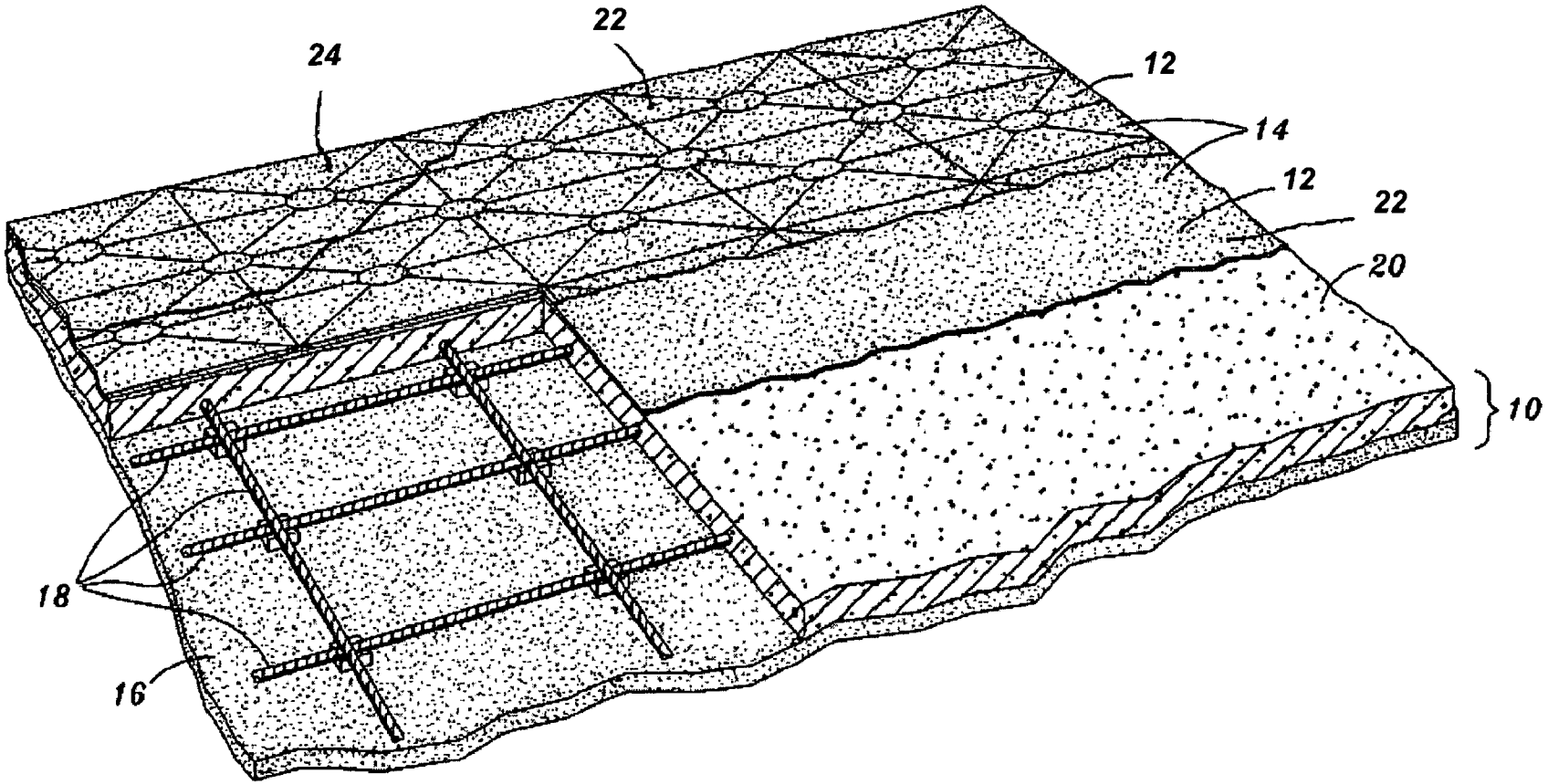
FIG. 1 is a perspective view illustrating stages of preparation of a surface seeded exposed aggregate concrete.
Figure 2:
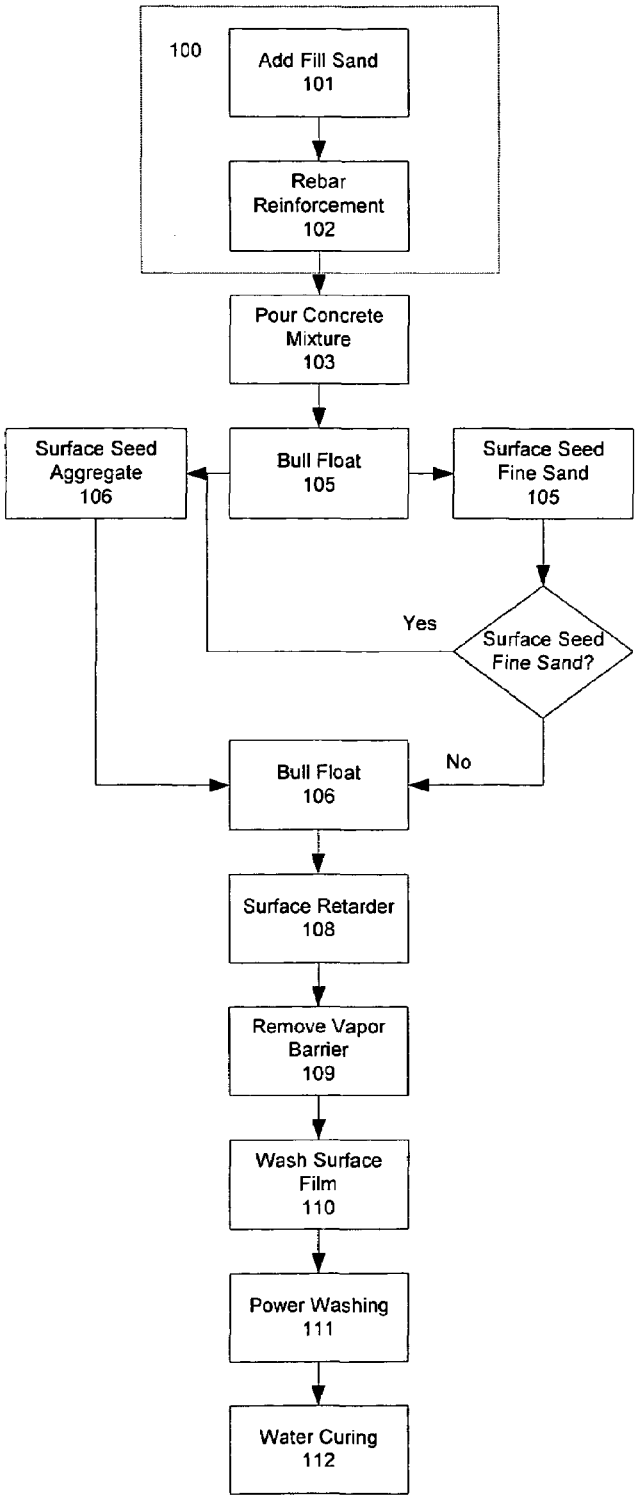
FIG. 2 is a process flow showing the steps of preparing the surface seeded exposed aggregate concrete as shown in FIG. 1.

Referring now to the drawings wherein the showings are for purpose of illustrating the preferred embodiments of the invention only, and not for purpose of limiting the same, FIGS. 1 and 2 illustrate the simulated quarried stone and the method of producing the same. As shown, the initial step comprises preparation of the subgrade 10 to a desired elevation and grade and to compact the same preferably to ninety percent (90%) compaction. As shown in FIG. 1, a layer of clean, moist fill sand 16 with a thickness of at least 4 inches. It will be appreciated that although the fill sand 16 is not absolutely necessary for the method of producing the simulated quarried stone, it is highly desirable to control the hydration process of the concrete. In order to increase the resultant strength of the concrete and reduce subsequent cracking of the same, reinforcement members 18 such as a wire mesh or rebar is positioned upon the layer of fill sand 16. The layer which includes fill sand 16 and the reinforcement member 18 is often referred as the subgrade 10.

A concrete mixture 20 is poured over the subgrade 10 such that the reinforcement members 18 are encapsulated within the concrete mixture 20. The concrete mixture 20 is poured to a thickness of about three and a half inches to about four inches. Although variations in the concrete mixture 20 are contemplated, a preferred concrete mixture 20 comprises seventy percent (70%) of sand and thirty percent (30%) of aggregate combined with six or seven sacks of cement. Preferably, the mean diameter of the aggregate is about three-eighths (3/8) inches, and the density of the cement is 2,000 or 3,000 pounds per square inch when six or seven sacks of cement is used, respectively. Depending on individual preference, various color mixtures can be added to the concrete mixture 20.

The concrete mixture 20 poured over the subgrade 10 is then screeded to a desired level plane or grade. The screeding of the concrete mixture 20 defines a generally level or planar upper exposed surface 22. To avoid bringing up too much cement/fines in the concrete mixture 20 which would be prohibited for the subsequent surface seeding, tamping of the concrete mixture 20 is avoided. Instead, the exposed surface 22 of the concrete mixture is surfaced or finished to dispose a quantity of the cement/fine paste derived from the concrete mixture 20 at the exposed surface thereof. The finishing may be done utilizing a vibrating bull float. The vibrating bull float is typically characterized by possessing an extremely smooth or polished surface which, in addition to bringing up the appropriate amount of cement/fine paste for the subsequent manipulative steps of the present invention, also tends to seal the exposed surface 22 of the concrete mixture 20. Although various types of bull floats may be used to perform the initial finishing step, the vibrating metal bull float such as a vibrating magnesium bull float or a vibrating aluminum bull float provides promising effect of the initial finishing process. A preferred metal bull float is sold under the trademark HAL200 by the Lievers Holland Co.

In the previous U.S. patent application Ser. No. 11/236,973 filed by the inventor, both fine sand and aggregate are broadcast over all the exposed surface of the concrete mixture 20 when the concrete mixture 20 is still plastic. In one embodiment of the current application, instead of broadcast both fine sand and aggregate, one can select only one of the fine sand and the aggregate to broadcast over the concrete mixture 20. In addition, the fine sand and/or the aggregate is only broadcast over five to sixty percent (5%-60%) of the exposed surface of the concrete mixture 20 to significantly reduce the cost and the labor while the simulated aesthetic effect can be achieved.

The fine sand as shown in FIG. 1 may be of any given color or texture as required to produce the simulated quarried stone. Various combinations of colors, textures, or other characteristics of the fine sand 12 may be created in order to accurately simulate quarried stone. In come instances, multiple types of fine sands 12 may be utilized in a given project to produce the desired aesthetic effects. In other instances, the fine sand 12 may be of a single type. In this regard, the coloring and/or patterns created utilizing the fine sand may be produced depending upon the manner in which the fine sand 12 is broadcast upon the exposed surface 22. As discussed above, depending on the desired aesthetic effect, the fine sand 12 is overcast over only 5% to 60% of the exposed surface 22 to produce a shade or color as the simulated quarried stone, or may be alternated with other colors of the fine sand 12 or quantity thereof to simulate the various aspects of natural quarried stone such as graining, fractures, joints, knots, crystallization patterns, sand seams, streaks, subjoints, weathering, and/or rock texture properties such as porphyritic, ophitic, and orei.

Alternately, one may choose to use a quantity of aggregate 14 instead of using the fine sand 12. Similar to the fine sand 12, the color, texture or size of the aggregate 14 may be varied according to the desired simulated quarried stone, and the aggregate 14 will only be broadcast over 5% to 60% of the exposed surface 22 of the concrete mixture 20. In an alternate embodiment, the aggregate 14 may be used in combination with the fine sand 12; however, both the fine sand 12 and aggregate 14 are not broadcast over the whole exposed surface 22 of the concrete mixture 20. In stead, the fine sand 12 and the aggregate 14 will only be broadcast over 5% to 60% of the exposed surface 22 of the concrete mixture 20.

The broadcasting of the fine sand 12 and the aggregate 14 may be performed utilizing pneumatic equipment which provides more precision and evenness in the placement of the fine sand 12 and/or aggregate 14 during broadcasting. The pneumatic equipment also allows the operator to produce a randomized pattern or a design corresponding to a particular natural quarried stone, so as to enhance the appearance of the exposed surface 22.

After being broadcast upon the exposed surface 22 of the concrete mixture 20, the fine sand 12 and/or the aggregate 14 are mixed or worked into the exposed surface 22 of the concrete mixture 20. More specifically, the fine sand 12 and/or the aggregate 14 are mixed into the cement/fine paste of the exposed surface 22. This mixing step is critical to ensure the fine sand 12 and/or aggregate 14 to be fully embedded into the cement/fine paste and thoroughly adhered or bonded to the exposed surface 22 of the concrete mixture 20 upon resultant curing.

Subsequent to the mixing step, the exposed surface 22 may be finished with a power trowel to properly level and finished. A chemical surface retarder may be sprayed upon the exposes surface to uniformly cover the same. The chemical retarder slows down the hydration process of the concrete mixture 20. The application of the surface retarder to the exposed surface 22 may be followed by the step of finishing the exposed surface 22 of the concrete mixture 20 with the power trowel, such that the surface retarder can be massaged into the cement/fine paste having the fine sand 12 and/or the aggregate 14 mixed therein. The finishing step preferably results in the penetration of the surface retarder into the cement/fine paste a distance below the maximum depth of the fine sand 12 and the aggregate 14, which may be at least approximately ⅜ inches in some instances. Advantageously, this particular finishing step may eliminate hard spots in the resulted concrete by facilitating a full mix of the retarder and the cement fine paste. The power trowel preferably used in relation to both this and the previously mentioned step finishes the exposed surface 22 of the concrete mixture 20 in a generally circular motion. Although various surface retarders may be utilized, a superior surface retarder designated as SPEC AE manufactured by E. L. Moor Co. of Costa Mesa, Calif. is preferred.

After the surface retarder is massaged into the cement/fine paste, a vapor barrier may be preferably formed on the exposed surface 22 of the concrete mixture 20. In one embodiment, the formation of the vapor barrier is facilitated by the application of a liquid chemical evaporation reducer to the exposed surface 22 of the concrete mixture 20. A preferred evaporation reducer is sold under the trademark CONFILM by the Concrete Tie Co. of Compton, Calif. An alternative vapor barrier may be formed by covering the exposed surface 22 with four or six millimeters of visquene. The vapor barrier is maintained upon the exposed surface 22 of the concrete mixture 20 for a predetermined period of time ranging from approximately two to twenty-four hours.

After maintaining the vapor barrier on the exposed surface 22 for the predetermined period of time, the exposed surface 22 of the concrete mixture 20 may be washed with water to remove any surface films therefrom. In this washing procedure, it may be preferable to lightly brush the exposed surface 22 with a bristle brush. This may be done according to design requirements in creating a simulated quarried stone appearance. The washing step, as described herein, may be done without excessive dislodgement and loss of the fine sand 12 or t aggregate 14 due to the full mixture of the retarder and cement/fine paste performed during the power troweling of the exposed surface 22. Additionally, the application of the liquid evaporation reducer to the exposed surface 22 may also reduce the rate of the evaporation of moisture from the exposed surface 22 and increase the ease to wash the excess cement/fine paste and residual surface retarder from the exposed surface 22.

After the washing the step, the concrete mixture 20 may be cured utilizing water alone, as opposed to chemical curing agent in order to avoid staining of the exposed surface 22. Such water curing may typically be facilitated through the use of a conventional fogger or soaker hose. After a prescribed period of time (e.g. 30 days after initiating the curing process) any surface residue present on the exposed surface 22 is removed by conventional power washing with a 90% steam and 10% muriatic acid mixture which is applied by a power washer via a high pressure nozzle.

The resultant surface exhibits an appearance of natural quarried stone. Further, as an extremely flat surface seeded exposed aggregate surface, it is also suitable for high pedestrian traffic. As described above, various modifications in the color, size, texture and other characteristics of the fine sane 12 and/or the aggregate 14 may be modified in order to produce numerous types of simulated quarried stone.

The process flow of the method for producing the simulated quarried stone by surface seeded exposed aggregate concrete as described above is illustrated in FIG. 2. As shown, the initial step of producing the simulated quarried stone includes a step of forming the subgrate 100, which includes a step 101 of adding fill sand, followed by a step of rebar reinforcement 102 over the fill sane. The concrete mixture is then poured over the subgrade in step 103, followed by the step of bull float 104 and the application of fine sand in step 105 or aggregate in step 106, respectively. As discussed above, the fine sand or the aggregate is broadcast on only 5% to 60% of the exposed surface of the concrete mixture. After the step of broadcasting the fine sand, the operator may select whether to perform aggregate broadcasting in step 106 or not. In step 107, the exposed surface is properly level and finished with a bull float, a hand float, or a power trowel. In step 108, a surface retarder is sprayed and massaged on the exposed surface to slow down the hydration process of the concrete mixture. A liquid chemical evaporation reducer is then applied to and maintained at the exposed surface for a predetermined period of time to facilitate a vapor barrier in step 109. In step 110, any surface films formed on the exposed surface 22 will be washed away. A power washing step 111 may be performed subsequent to the washing step 110; and after step 112, the concrete mixture is cured in step 112.

The aggregate may include various materials such as glass, mica or any other reactive aggregate and mineral that can be broadcast over the exposed surface 22 of the concrete mixture 20 to provide the aesthetic effect as desired. Again, although the substitute materials can be broadcast over the entire exposed surface 22 of the concrete mixture 20, to save the labor and cost, a predetermined percentage such as 5% to 60% of the exposed surface 22 may be sufficient to achieve the effect.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of seeding aggregate onto a surface, the method comprising the steps of:

preparing a subgrade;

pouring a concrete mixture over the subgrade, the concrete mixture defining an exposed surface;

broadcasting fine sand over 5% to 60% of the exposed surface of the concrete mixture while the concrete mixture is in a plastic state; and broadcasting aggregate over 5% to 60% of the exposed surface of the concrete mixture after the fine sand has been broadcast, the aggregate being broadcast while the concrete mixture is in the plastic state, the fine sand and aggregate collectively simulating the appearance of quarried stone.

2. The method of surface seeded aggregate as claimed in claim 1, wherein the step of preparing the subgrade further includes:

adding moist fill sand on a surface; and positioning reinforcement members on the moist fill sand.

3. The method of surface seeded aggregate as claimed in claim 2, wherein the moist fill sand is added with a thickness no less than 4 inches.

4. The method of surface seeded aggregate as claimed in claim 2, wherein the reinforcement members include wire mesh or rebars.

5. The method of surface seeded aggregate as claimed in claim 1, wherein the concrete mixture is poured to a thickness between about 3½ inches and about 4 inches.

6. The method of surface seeded aggregate as claimed in claim 1, further comprising the step of finishing the exposed surface with a bull float after the concrete mixture is poured and before the fine sand is applied.

7. The method of surface seeded aggregate as claimed in claim 1, wherein the fine sand is broadcast using a pneumatic device.

8. The method of surface seeded aggregate as claimed in claim 7, wherein the aggregate is broadcast using a pneumatic device.

9. The method of surface seeded aggregate as claimed in claim 1, wherein the exposed surface of the concrete mixture includes cement or fine paste, the method further comprising the step of mixing the fine sand or aggregate into cement or fine paste at the exposed surface of the concrete mixture after the fine sand or the aggregate is broadcast.

10. The method of surface seeded aggregate as claimed in claim 9, further comprising using a power trowel to perform the step of mixing the fine sand or aggregate into the cement or fine paste at the exposed surface of the concrete mixture.

11. The method of surface seeded aggregate as claimed in claim 9, further comprising a step of massaging a surface retarder to the exposed surface of the concrete mixture.

12. The method of surface seeded aggregate as claimed in claim 11, further comprising a step of forming a vapor barrier on the exposed surface of the concrete mixture.

13. The method of surface seeded aggregate as claimed in claim 12, wherein the vapor barrier is formed by applying a liquid chemical evaporation reducer to the exposed surface of the concrete mixture.

14. The method of surface seeded aggregate as claimed in claim 12, wherein the vapor barrier is formed by covering the exposed surface of the concrete mixture by a predetermined length of visquene.

15. The method of surface seeded aggregate as claimed in claim 12, wherein the vapor barrier is maintained on the exposed surface of the concrete mixture for a predetermined period of time.

16. The method of surface seeded aggregate as claimed in claim 15, wherein the predetermined period of time includes two to twenty-four hours.

17. The method of surface seeded aggregate as claimed in claim 12, further comprising a step of removing any surface films of the exposed surface of the concrete mixture.

18. The method of surface seeded aggregate as claimed in claim 17, further comprising the step of curing the concrete mixture with water.

19. The method of surface seeded aggregate as claimed in claim 1, wherein the aggregate includes glass, mica or other reactive aggregate, mineral, and a combination thereof.

20. A simulated quarried stone fabricated by a method of seeding aggregate onto a surface, the method comprising the steps of:

preparing a subgrade;

pouring a concrete mixture over the subgrade, the concrete mixture defining an exposed surface;

broadcasting fine sand over 5% to 60% of the exposed surface of the concrete mixture while the concrete mixture is in a plastic state; and broadcasting aggregate over 5% to 60% of the exposed surface of the concrete mixture after the fine sand has been broadcast, the aggregate being broadcast while the concrete mixture is in the plastic state, the fine sand and aggregate collectively simulating the appearance of quarried stone.

21. The method of surface seeded aggregate as claimed in claim 20, wherein the fine sand is broadcast using a pneumatic device.

22. A method of seeding aggregate onto a surface, the method comprising the steps of:

preparing a subgrade;

pouring a concrete mixture over the subgrade, the concrete mixture defining an exposed surface;

broadcasting aggregate over 5% to 60% of the exposed surface of the concrete mixture while the concrete mixture is in a plastic state; and broadcasting fine sand over 5% to 60% of the exposed surface of the concrete mixture after the aggregate has been broadcast, the fine sand being broadcast while the concrete mixture is in the plastic state, the fine sand and aggregate collectively simulating the appearance of quarried stone.

* * * * *